US005467624A

United States Patent [19]

Myers

[11] Patent Number: 5,467,624

[45] Date of Patent: Nov. 21, 1995

[54] DUST SHUTTER ASSEMBLY FOR LOCKS

[75] Inventor: Gary L. Myers, Monee, Ill.

[73] Assignee: Fort Lock Corporation, River Grove, Ill.

[21] Appl. No.: 304,366

[22] Filed: Sep. 12, 1994

[51] Int. Cl.[6] ..... E05B 17/18

[52] U.S. Cl. ..... 70/455; 70/423; 70/427

[58] Field of Search ..... 70/423, 427, 455, 70/454, 420, 424, 425, 426, 428, 55

[56] References Cited

U.S. PATENT DOCUMENTS

| | | | |
|---|---|---|---|
| 2,655,031 | 10/1953 | Jacobi | 70/455 |
| 2,932,186 | 4/1960 | Mahrley | 70/455 |
| 2,993,362 | 7/1961 | Baccolla | 70/454 |
| 3,096,626 | 4/1962 | Jacobi | 70/455 |
| 3,122,013 | 2/1964 | Jacobi | 70/455 |
| 3,367,156 | 2/1968 | Johnstone | 70/373 |
| 4,006,616 | 2/1977 | Rubner et al. | 70/455 |
| 4,561,270 | 12/1985 | Spreng | 70/495 |
| 4,594,866 | 6/1986 | Neyret | 70/423 X |
| 4,671,090 | 6/1987 | Masaki et al. | 70/454 X |

FOREIGN PATENT DOCUMENTS

| | | | |
|---|---|---|---|
| 546395 | 3/1932 | Germany | 70/455 |
| 1904999 | 10/1970 | Germany | 70/455 |
| 3517573 | 11/1986 | Germany | 70/455 |
| 0158142 | 9/1982 | Japan | 70/455 |

*Primary Examiner*—Lloyd A. Gall
*Attorney, Agent, or Firm*—Leydig, Voit & Mayer, Ltd.

[57] ABSTRACT

An improved dust shutter assembly for locks includes a floating hinge point which decreases the amount of axial key force that is necessary to overcome the spring bias in the dust shutter mechanism. When engaged by a key, the spring retention pin (hinge point) of the dust shutter mechanism moves within the pin slots of the lock plug cavity until it bottoms out against the back of these slots. Pin translation is primarily axial, in the direction of key insertion, which partially unloads the spring and reduces the amount of key force that is required to open the shutter door. Since less key force is necessary, a narrower shutter door can be used. The chief advantage of a narrower shutter door includes a corresponding reduction in the size and length of the entire lock assembly.

5 Claims, 3 Drawing Sheets

DUST SHUTTER ASSEMBLY FOR LOCKS

BACKGROUND OF THE INVENTION

1. Field of the Invention

The present invention relates generally to locks, and, more particularly, concerns an improved dust shutter assembly for use in locks.

2. Description of the Prior Art

A dust shutter is a spring loaded hinge type device which permits the insertion of a flat key into a lock but which seals the keyway slot when the lock is not engaged by a key. Its principal purpose is to prevent dust and other debris from entering the lock through the keyway slot and damaging the tumblers within the lock plug. As incorporated into conventional locks, dust shutters are usually placed within a cavity located at the forward end of the lock plug and are secured in place by a lock plug cover.

In general, dust shutter assemblies typically include a helical torsion spring, a spring retention pin, and a shutter door. The spring retention pin serves two basic functions: (1) it holds both the helical torsion spring and the shutter door in position; and (2) it provides an axis, or hinge point, within the lock plug cavity about which the shutter door can pivot.

In the closed position, when the lock is not engaged by a key, the helical torsion spring holds the shutter door in place against the inner face of the lock plug cover, effectively closing the keyway slot and protecting the internal lock tumblers from the environment. In this position, one or more ends of the spring are loaded against the inner face of the shutter door and the other end(s) are loaded against the internal face of the lock plug cover. When a key is pressed against the outer face of the shutter door and is inserted into the lock plug cavity, however, the axial force exerted by the key pivots the shutter door about the retaining pin which provides a hinge point for the dust shutter assembly. Throughout the key insertion process, the torsion spring remains in contact with the inner face of the shutter door which is further compressed as the shutter door rotates about the pin. When the key is eventually removed from the lock plug, the dust shutter assembly returns to the closed position with the dust shutter door again in contact with the inner face of the lock plug cover. In essence, the dust shutter mechanism operates like a spring loaded door, biased in the closed position, which must be forced open.

Within the art, spring retention pins may either be completely or partially fixed in place. A completely fixed pin, by definition, has no pin translation and the shutter door simply rotates about a fixed axis. A partially fixed pin, on the other hand, permits some pin translation in addition to shutter door rotation. Typically, spring retention pins are partially fixed in place by inserting it into two opposed axial slots situated within the lock plug cavity. This type of configuration permits a tiny amount of restricted pin motion, but the magnitude of pin displacement is limited by the length and width of the pin slots. In practice, pin slots are relatively short and narrow, and, as a result, the pin is in contact with the back of the slot both before and during the entire key insertion process. Thus, even with pin slots, the pin is effectively anchored against the rear of the axial pin slots, and, similar to the fixed pin configuration, the shutter door tends to merely rotate about the pin.

A major disadvantage of a dust shutter with a fixed or effectively fixed spring retention pin is that a relatively large key insertion force and/or a wide shutter door with a sufficient moment arm is necessary to generate enough leverage to overcome the spring bias in the dust shutter mechanism. Lock manufacturers customarily opt for a wide dust shutter door, rather than a prohibitive key insertion force. As the width of the shutter door increases, however, the depth of the lock plug cavity must also increase as well as the overall length and size of the lock plug which, in turn, boosts the material requirements and manufacturing costs of the assembly as a whole.

OBJECTS AND SUMMARY OF THE INVENTION

The primary object of the present invention is to produce a dust shutter mechanism for locks which requires less key entry force to open the shutter door than conventional dust shutters. This goal is accomplished through the use of elongated lock plug cavity pin slots which permits the spring retention pin to translate axially rearward during key insertion, creating, in effect, a floating hinge point which partially unloads the helical torsion spring and reduces the amount of axial key force that is required to open the shutter door.

A further object of the present invention is to provide a dust shutter door which is narrower than traditional dust shutter doors while providing ease of key entry.

A related object of the present invention is to furnish a dust shutter mechanism which requires less lock plug cavity space.

These and other features and advantages of the invention will be more readily apparent upon reading the following description of a preferred exemplified embodiment of the invention and upon reference to the accompanying drawings wherein:

While the invention will be described and disclosed in connection with certain preferred embodiments and procedures, it is not intended to limit the invention to those specific embodiments. Rather it is intended to cover all such alternative embodiments and modifications as fall within the spirit and scope of the invention.

DETAILED DESCRIPTION OF THE PREFERRED EMBODIMENT

Figure 1:
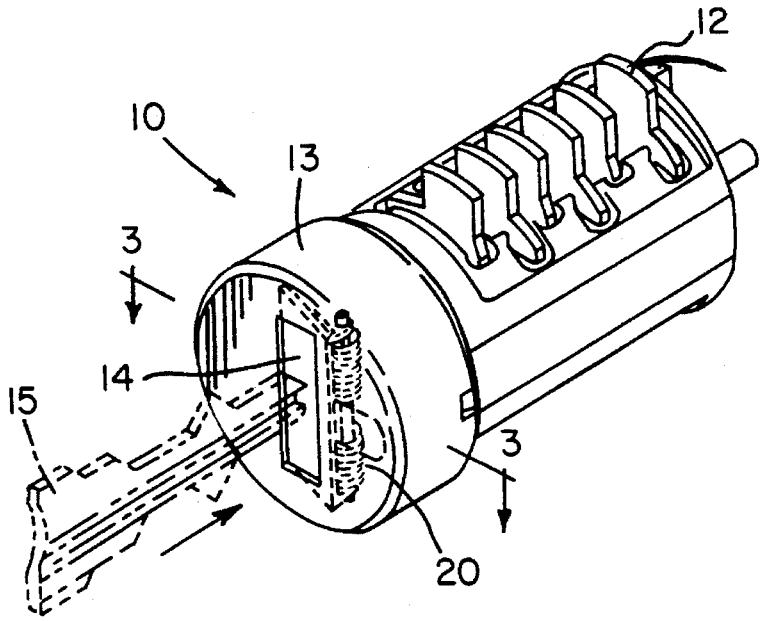
FIG. 1 is a perspective view of the lock assembly and its component parts illustrating the manner in which a key engages the dust shutter mechanism of the present invention.
Figure 2:
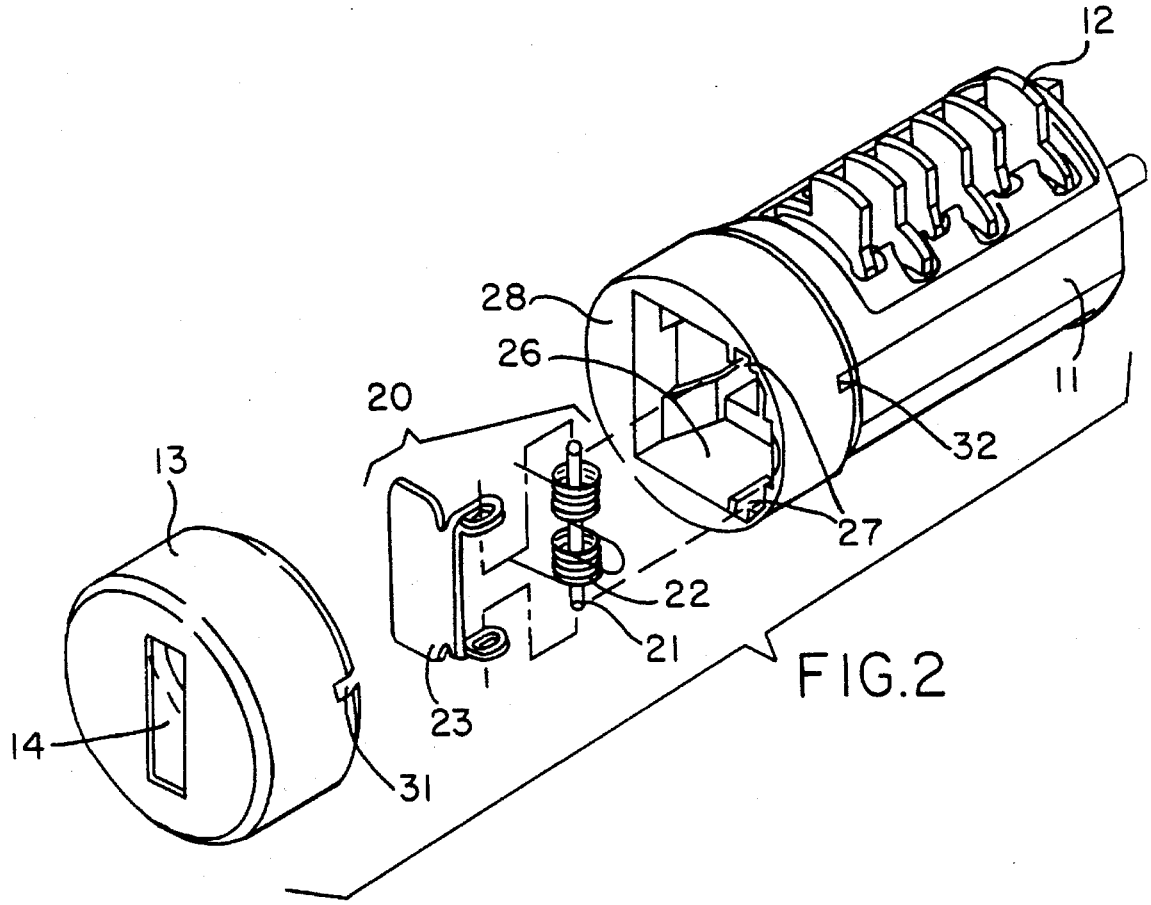
FIG. 2 is an exploded perspective view of the lock assembly and its component parts.

As shown generally in FIG. 1 of the drawings, the present invention is embodied in a lock assembly 10 which broadly comprises: a lock plug 11 with a set of tumblers 12; a lock plug cover 13 with a keyway slot 14; a flat key 15; and a dust shutter assembly 20. FIG. 2 shows an exploded perspective view of the invention and its component parts. In particular, the dust shutter assembly 20 includes a spring retention pin 21, a helical torsion spring 22, and a shutter door 23. The helical torsion spring 22 has two wire ends and a curved mid-section which protrude tangentially outward; the shutter door 23 has two hinge joints and a face; and the spring retention pin 21 is simply a small cylindrical rod which provides an axis, or hinge point, about which the shutter door 23 can rotate.

In the preferred embodiment, the three individual components of the dust shutter assembly 20 are put together prior to installation into the lock plug 11, with the spring loading of the helical torsion spring 22 holding the dust shutter assembly 20 together as a unit. Specifically, the spring retention pin 21 is inserted through both the center of the helical torsion spring 22 and the two hinge joints of the shutter door 23. However, prior to inserting the pin 21 through the hinge joints and the spring axis, the spring 22 must be prestressed such that when it partially unloads into position, as shown in FIG. 3A, the two wire ends press against the inner face of the shutter door while the curved mid-section presses against the edge of the shutter door.

Once assembled, the dust shutter assembly 20 is installed within the lock plug cavity 26 located at the forward end of the lock plug 11. As depicted in FIG. 2, the ends of the spring retention pin 21 slide into the two pin slots 27 located at the forward face 28 of the lock plug 11. The pin slots 27, which are parallel but offset from the keyway slot 14, extend axially into the lock plug cavity 26 and have a transverse width in excess of the diameter of the spring retention pin 21. After the dust shutter assembly 20 has been placed within the pin slots 27, the sleeve of the lock plug cover 13 can be slid over the forward end of the lock plug 11.

In one embodiment, an alignment slot 31 located on the sleeve of the lock plug cover 13 engages an alignment tab 32 located on the outer circumferential periphery of the lock plug 11 which properly orients the lock plug cover 13 onto the lock plug 11. Once in place, the lock plug cover 13 can be permanently joined to the lock plug 11 by swaging the end of the lock plug cover sleeve over a small circumferential flange located on the outer periphery of the lock plug 11.

Figure 3A:
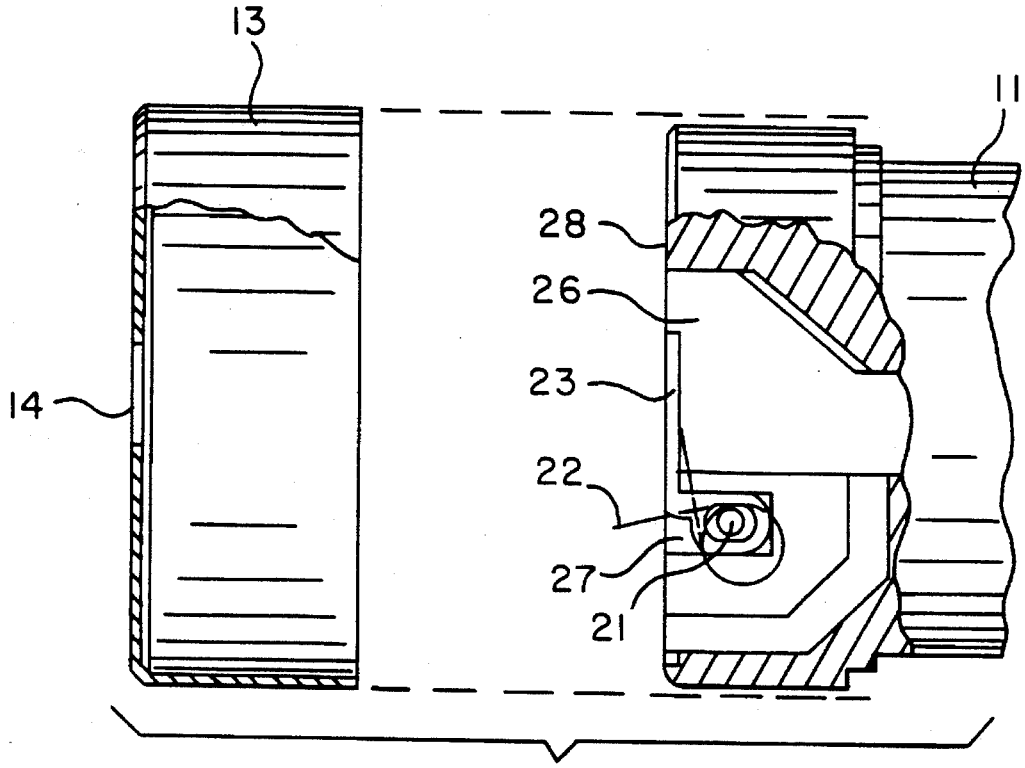
FIG. 3A is a fragmentary cross-sectional view of the lock assembly prior to installing the lock plug cover, taken along lines 3—3 of FIG. 1.
Figure 3B:
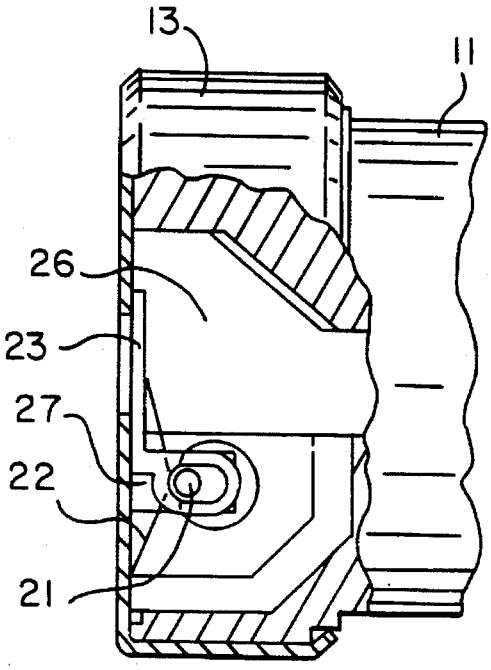
FIG. 3B is a fragmentary cross-sectional view of the lock assembly after installing the lock plug cover, also taken along lines 3—3 of FIG. 1, with the dust shutter mechanism in the fully engaged, or closed, position.

FIGS. 3A–3B of the drawings illustrate what physically happens to the dust shutter assembly 20 as the lock plug cover 13 is installed onto the lock plug 11. Prior to installing the lock plug cover 13, the dust shutter assembly 20 is free to rotate about the spring retention pin 21 which is placed within the lock plug cavity pin slots 27. And, as shown in FIG. 3A, when the outer face of the shutter door 23 is aligned with the forward face 28 of the lock plug 11, the curved mid-section of the helical torsion spring 22 extends above the forward face 28 of the lock plug 11. Once the lock plug cover 13 has been installed, however, the inner face of the lock plug cover 13 compresses the mid-section of the spring 22 until it is in line with the forward face 28 of the lock plug 11, as depicted in FIG. 3B. Installation of the lock plug cover 13 further compresses the helical torsion spring 22 which pushes the shutter door 23 firmly against the inner face of the lock plug cover 13 and also axially translates the spring retention pin 21 slightly forward in the pin slots 27.

Figure 3C:
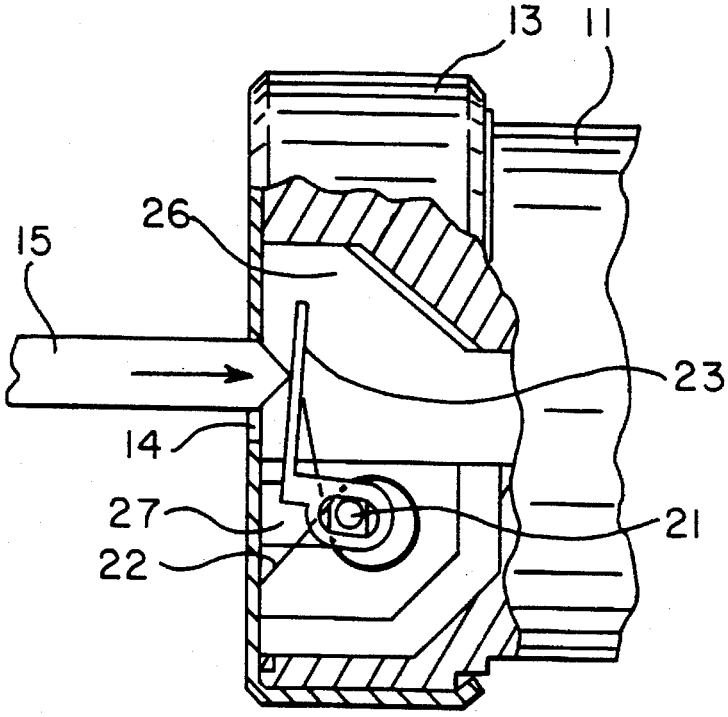
FIG. 3C is a fragmentary cross-sectional view of the lock assembly after installing the lock plug cover, also taken along lines 3—3 of FIG. 1, but with the key partially inserted into lock plug cavity and with the dust shutter mechanism in the partially engaged position.
Figure 3D:
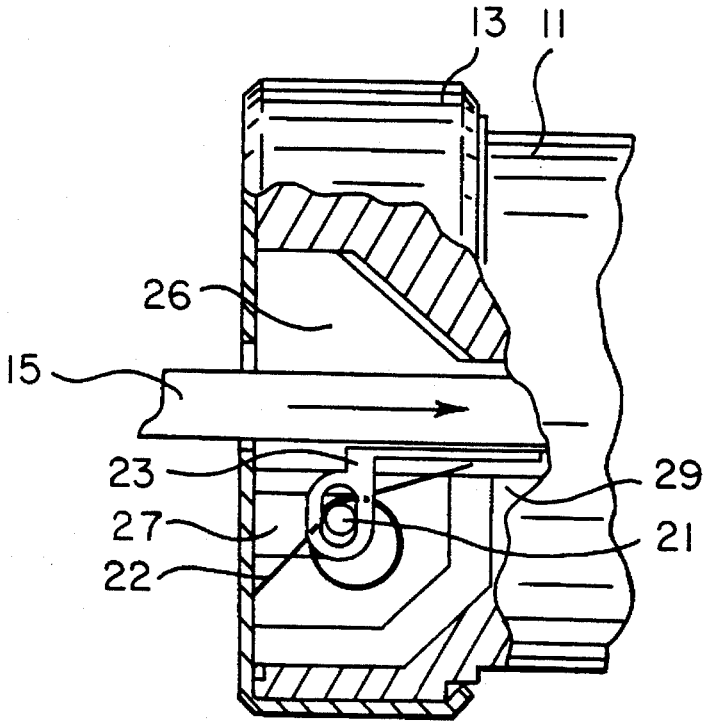
FIG. 3D is a fragmentary cross-sectional view of the lock assembly after installing the lock plug cover, also taken along lines 3—3 of FIG. 1, but with the key fully inserted into the lock plug and the dust shutter mechanism in the fully disengaged, or open, position.

After the lock plug cover 13 has been installed, the lock assembly 10 is complete and ready for use. FIGS. 3C–3D of the drawings show what transpires within the lock plug cavity 26 as a key 15 is inserted into the lock plug 11. Upon partial key insertion, the spring retention pin 21 of the dust shutter assembly 20 moves axially rearward within the pin slots 27 (i.e. in the direction of key insertion) and continues until the pin 21 bottoms out against the back of the pin slots 27 as shown in FIG. 3C. As the hinge point moves to the rear of the pin slots 27, the helical torsion spring 22 partially unloads which reduces the amount of key insertion force that is required to open the shutter door 23. Since less axial key force is necessary, key insertion is easier and less shutter door 23 width is required in the initial design of the lock assembly 10. Once the key 15 has been completely inserted into the lock plug 11, as depicted in FIG. 3D, the pin 21 remains in contact with the back of the pin slots 27 and the shutter door 23 pivots 90° about the pin axis 21 until the shutter door 23 is effectively wedged between the key 15 and a shoulder 29.

I claim as my invention:

1. A lock assembly with an improved dust shutter mechanism comprising, in combination:

a generally cylindrical lock plug having a first end, a second end, tumblers disposed between said first and second ends which are engageable by a flat key, and a dust shutter cavity disposed between said first end and said tumblers, said cavity having two axial slots;

a lock plug cover having a face and a cylindrical sleeve, said face having a keyway slot and an inner surface, said sleeve being slidably receivable over said first end of said lock plug;

a dust shutter door rotatably disposed within said cavity, said shutter door having a face portion with inner and outer surfaces and a pair of hinge joints, each hinge joint having an inner contour, said outer surface of said shutter door engages said inner surface of said lock plug cover when said key is not inserted into said cavity;

a torsion spring having a center portion with an inner diameter, one or more wire protuberances which extend tangentially outwardly from said center portion and which load against said inner surface of said dust shutter door, and one or more additional wire protuberances which extend tangentially outwardly from said center portion and which load against said inner surface of said lock plug cover; and a pin having two ends, said pin fitting within said inner diameter of said torsion spring and also fitting within said inner contours of each hinge joint of said dust shutter door, said ends of said pin fitting within said axial slots of said dust shutter cavity, said axial slots having sufficient axial length to permit axial translation of said pin within said slots such that when said key is pressed against said shutter door, said door moves axially rearward, in the direction of key insertion, and rotates about said pin.

2. A lock assembly as defined in claim 1 wherein said lock plug cover is swaged in place onto the first end of said lock plug over a circumferential flange located on the outer periphery of said lock plug.

3. A lock assembly as defined in claim 2 wherein an alignment slot located on said sleeve of said lock plug cover is slidably receivable onto an alignment tab located on the outer periphery of said lock plug.

4. A lock assembly as defined in claim 1 wherein said inner contours of said hinge joints are elliptical in shape.

5. A lock assembly as defined in claim 1 wherein said lock plug further comprises a shoulder disposed between said cavity and said tumblers, said face portion of said dust shutter door being disposed between said shoulder and said key when said key is inserted into said tumblers of said lock plug.

* * * * *